United States Patent [19]

Fry et al.

[11] Patent Number: 4,893,438

[45] Date of Patent: Jan. 16, 1990

[54] FAN FOLDED ABRASIVE DISCS

[75] Inventors: Richard L. Fry, White Bear Lake; Gerald L. Bergsrud, Maplewood, both of Minn.; Russell J. Maland, Ames, Iowa; James A. Weldon, Eagan, Minn.

[73] Assignee: Minnesota Mining and Manufacturing Company, Saint Paul, Minn.

[21] Appl. No.: 245,462

[22] Filed: Sep. 6, 1988

[51] Int. Cl.[4] ..... B24D 11/00

[52] U.S. Cl. ..... 51/394; 51/407; 206/395; 206/820; 221/70

[58] Field of Search ..... 51/358, 359, 394, 400, 51/401, 406, 407; 221/63, 70; 206/820, 395

[56] References Cited

U.S. PATENT DOCUMENTS

| | | | |
|---|---|---|---|
| 1,983,463 | 12/1934 | Kingsbury | 206/820 X |
| 2,732,065 | 1/1956 | Marchese | 206/820 X |
| 3,164,250 | 1/1965 | Paxton | 206/820 X |
| 3,225,916 | 12/1965 | Field et al. | 206/56 |
| 3,267,623 | 8/1966 | Block | 51/406 |
| 3,912,142 | 10/1975 | Steinhauser et al. | 225/52 |
| 4,245,765 | 1/1981 | Gregg | 225/13 |
| 4,592,840 | 6/1986 | Brooks | 210/497.2 X |
| 4,609,581 | 9/1986 | Ott | 51/358 X |
| 4,617,767 | 10/1986 | Ali | 51/358 |

FOREIGN PATENT DOCUMENTS 0021348 1/1981 European Pat. Off. .

*Primary Examiner*—Robert P. Olszewski

*Attorney, Agent, or Firm*—Donald M. Sell; Walter N. Kirn; William L. Huebsch

[57] ABSTRACT

A concatenation of circular abrasive discs each having a layer of abrasive material on a first surface, and means on a second surface for releasably attaching said discs to a drive member. The discs are attached to two adjacent discs at opposite edges by two narrow tabs along each edge spaced by at least 0.32 centimeter ($\frac{1}{8}$ inch) along the edge and generally equally spaced on opposite sides of a center line extending between the centers of the attached discs. Also the discs are separated between the tabs and the tabs are folded to position abrasive discs in a stack within a container with each abrasive disc in the stack having its layer of abrasive against the layer of abrasive of one adjacent disc, and its means for attaching adjacent the means for attaching of the other adjacent disc.

12 Claims, 1 Drawing Sheet

FAN FOLDED ABRASIVE DISCS

TECHNICAL FIELD

The present invention relates to concatenations of abrasive discs, the means by which the discs are attached together, and the disposure of the discs in a container prior to use.

BACKGROUND ART

Various approaches described in EPO Pat. No. EP 0 021 348 and in U.S. Pat. Nos. 3,225,916, 3,912,142 and 4,245,765 have been used to form concatenations of abrasive discs and store the discs in containers prior to use. The discs described in these patents are releasably attached or adhered to a drive member by a layer of pressure sensitive adhesive on the side of the disc opposite the layer of abrasive. The discs described in EPO Pat. No. EP 0 021 348 and in U.S. Pat. No. 3,225,916 have release liners over their layers of pressure sensitive adhesive and are stored prior to use by having a strip or lengths of adhesive coated tape adhered to the release liners of a plurality of the discs with the discs spaced along the tape, and either rolling the thus attached discs into a coil or folding the tape between certain of the discs to position the abrasive discs in a stack with each abrasive disc in the stack having its layer of abrasive against the layer of abrasive of one adjacent disc, and its adhesive covering release liner adjacent the adhesive covering release liner of the other adjacent disc; and enclosing the coil or stack of attached discs in a container. The discs described in U.S. Pat. Nos. 3,912,142 and 4,245,765 have been cut from a single sheet of stock and each have been attached to two adjacent discs along opposite edges by one wide tab or a series of narrow tabs along each edge so that the discs can be separated by cutting or breaking the tabs and the discs are rolled into a coil positioned in a container having means for facilitating breaking or cutting the tabs so that single discs may be removed from the coil as needed. Also, such discs having release liners over their layers of adhesive have been stored in a stack in a container with the abrasive of each disc in the stack adjacent the liner of the adjacent disc.

While such approaches are acceptable for storing discs adapted to be attached to a drive member by layers of pressure sensitive adhesive, none of these approaches is acceptable for discs which are adapted to be attached to a drive member by a multiplicity of loops projecting from the side of the disc opposite the layer of abrasive. Individual discs placed in a box with the loops on one disc against the abrasive of another are hard to stack one above the other because the loops will not slide across the abrasive. The use of adhesive coated tape to attach discs together would add expense and could compress and be difficult to separate from the loops. Rolling such discs attached together at their edges into a coil tends to flatten the loops and abrasive discs having coating of heavy grits can not be wound on a small core (which is also a problem for pressure sensitive adhesive coated discs).

DISCLOSURE OF INVENTION

The present invention provides a concatenation of abrasive discs disposed in a container that can have loops by which said discs may be releasably attached to a drive member having hooks adapted to releasably engage the loops, which discs are disposed in the container so that the loops are not crushed or engaged with the abrasive and can move relative to each other while in face to face engagement to facilitate proper alignment of the discs into a stack in the container.

According to the present invention there is provided a concatenation of circular abrasive discs each including a layer of abrasive material on a first surface of a backing and means on a second surface for releasably attaching the discs to a drive member (which can be a multiplicity of projecting loops or a layer of pressure sensitive adhesive covered by a release liner) which discs are cut from a single sheet of stock and are each attached to two adjacent discs along opposite edges by two narrow tabs along each edge spaced by at least 0.32 centimeter ($\frac{1}{8}$ inch) and preferably by about 0.16 centimeter ($\frac{1}{8}$ inch) along the edge, which tabs are generally equally spaced on opposite sides of a center line extending between the centers of the attached discs. The discs are separated between the tabs and the tabs are folded to position the abrasive discs in a stack with each abrasive disc in the stack having its layer of abrasive against the layer of abrasive of one adjacent disc, and its loops or liner covered adhesive against the loops or liner covered adhesive of the other adjacent disc, which is particularly useful with discs having loops as it allows the discs to slide relative to each other so that they can more easily be stacked. The stack of sheets can be enclosed in a container which has a bottom wall supporting the bottom disc in the stack, and side walls projecting from the bottom wall along the edges of the discs in the stack, and a top structure that facilitated dispensing the discs individually from the container.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
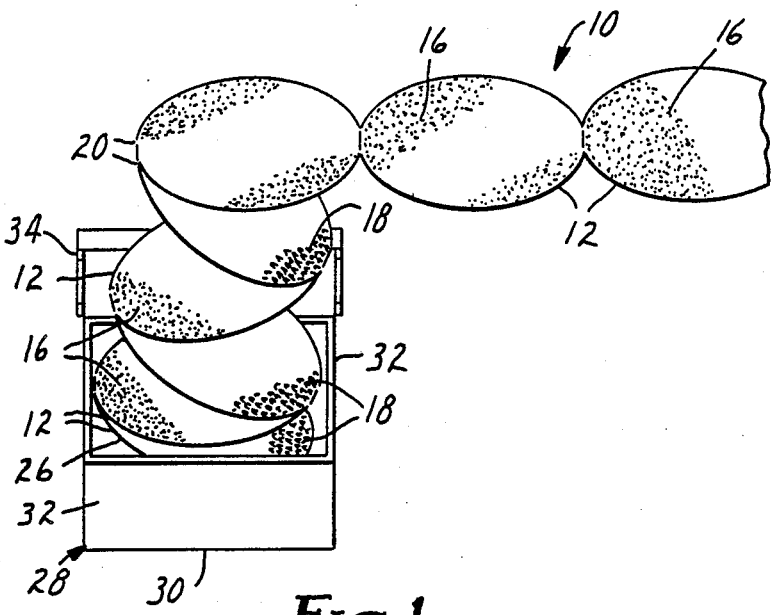
FIG. 1 is a perspective view of a concatenation of circular abrasive discs according to the present invention.

Referring now to FIG. 1 of the drawing, there is shown a concatenation of circular abrasive discs 12 according to the present invention, which concatenation is generally designated by the reference numeral 10.

Figure 2:
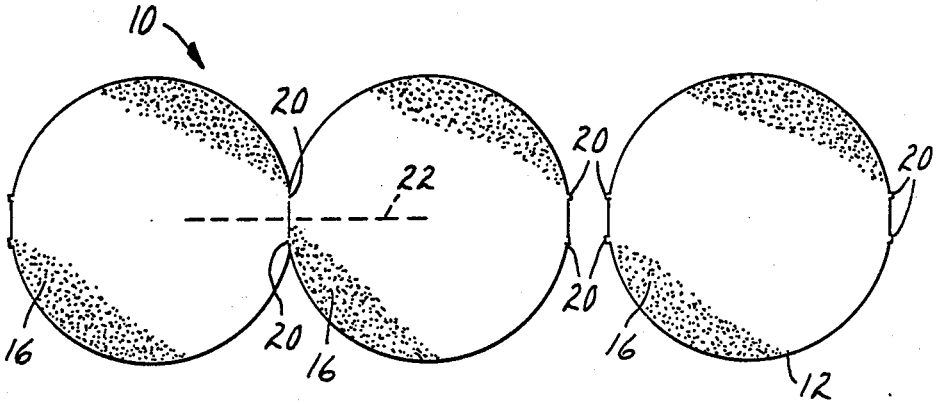
FIG. 2 is an enlarged fragmentary view of three discs from the concatenation of FIG. 1 with one disc broken away from the other two which illustrates connecting tabs between the discs.

Generally each of the circular abrasive discs 12 includes a backing having first and second major surfaces, a layer of abrasive material 16 on its first surface, and a multiplicity of loops 18 projecting from its second surface by which the disc 12 may be releasably attached to a drive member (not shown) having hooks adapted to releasably engage the loops 18. The discs 12 are cut from a single sheet of stock with each of the discs 12 being attached to two adjacent discs 12 along opposite edges by two narrow tabs 20 along each edge. The two tabs 20 along each edge are spaced by at least about 0.32 centimeter ($\frac{1}{8}$ inch) and preferably by about 1.6 centimeter ($\frac{5}{8}$ inch), and are generally equally spaced on opposite sides of an imaginary center line (illustrated in FIG. 2 by dotted line 22) extending between the centers of the attached discs 12. The discs 12 are separated between the tabs 20. Also, preferably each pair of adjacent discs 12 is attached by only two tabs 20, each of which tabs 20 is less than about 0.16 centimeter (1/16 inch) wide. Such spacing, separation of the discs 12 between the tabs 20, and tab width allows the tabs 20 to easily bend or fold and reliably form a hinge that will position the abrasive discs 12 in a stack 26 with each abrasive disc 12 in the stack 26 having its layer of abrasive material 16 against the layer of abrasive material 16 of one adjacent disc 12, and its loops 18 against the loops 18 of the other adjacent disc 12. Also, this engagement of similar surfaces of the discs 12 allows the discs 12 to slide sideways relative to each other if needed so that they can more easily be stacked.

The stack 26 of discs can be enclosed in a cardboard container 28 which has a bottom wall 30 supporting the bottom disc 12 in the stack 26, side walls 32 projecting from the bottom wall 30 along the edges of the discs 12 in the stack 26, and which has a top structure such as the conventional hinged cover 34 illustrated that facilitates dispensing the discs 12 one by one from the stack 26.

The sheet of stock from which the abrasive discs 12 and their connecting tabs 20 are cut can be formed in any known manner including that described in U.S. Pat. No. 4,609,581, the content whereof is incorporated herein by reference. The abrasive discs 12 and their connecting tabs 20 can be cut from the sheet of stock in a known manner by a rotary die assembly. It has been found that concatenations of cut discs 12 and connecting tabs 20 formed by such dies that have layers of larger size abrasive material (e.g., 40 or 36 grit) can be guided into the container 28 so that the discs 12 fold back and forth on themselves to form the stack 26 described above. It appears, however, that concatenations of cut discs 12 and connecting tabs 20 formed by such dies that have layers of smaller size abrasive material (e.g., 180 grit) will have to have the appropriate bends started in the tabs 20 as by a pair of gear like structures that guide the concatenation therebetween before the discs 12 will fold back and forth to form such a stack 26 when they are guided into the container 28.

Attachment between discs provided by only two tabs 20 spaced as indicated above with the discs 12 separated between the tabs 20 and the tab widths limited to allow the tabs 20 to easily bend or fold and reliably form a hinge so that the discs can be stacked is also useful for discs in which the means on a second surface for releasably attaching the discs to a drive member is a layer of pressure sensitive adhesive covered by a release liner rather than a multiplicity of projecting loops. The tabs can then be folded to position the abrasive discs in the stack with each abrasive disc in the stack having its layer of abrasive against the layer of abrasive of one adjacent disc, and its liner covered adhesive against the liner covered adhesive of the other adjacent disc.

The present invention has now been described with reference to two embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

We claim:

1. A concatenation of circular abrasive discs each including a backing having first and second major surfaces, a layer of abrasive material on said first surface, and a multiplicity of loops projecting from said second surface by which said discs may be releasably attached to a drive member having hooks adapted to releasably engage the loops, said discs being cut from a single sheet of stock and each disc being attached to two adjacent discs at opposite edges by two narrow tabs along each edge spaced by at least about 0.32 centimeter (⅛ inch) along said edge and generally equally spaced on opposite sides of a center line extending between the centers of the attached discs, said discs being separated between said tabs and said tabs being folded to position said abrasive discs in a stack with each abrasive disc within the stack having its layer of abrasive material against the layer of abrasive material of one adjacent disc, and its loops against the loops of the other adjacent disc.

2. A concatenation of circular abrasive discs according to claim 1 wherein said two narrow tabs along each edge are spaced by about 1.6 centimeter (⅝ inch) and are each less than about 0.16 centimeter (1/16 inch) wide.

3. A concatenation of circular abrasive discs according to claim 1 wherein each disc is attached to two adjacent discs at opposite edges by only said two narrow tabs along each edge, said two tabs are spaced by about 1.6 centimeter (⅝ inch) and are each less than about 0.16 centimeter (1/16 inch) wide.

4. In combination, a concatenation of circular abrasive discs each including a backing having first and second surfaces, a layer of abrasive material on said first surface, and a multiplicity of loops projecting from said second surface by which said discs may be releasably attached to a drive member having hooks adapted to releasably engage the loops, said discs being cut from a single sheet of stock and each disc being attached to two adjacent discs at opposite edges by two narrow tabs along each edge spaced by at least 0.32 centimeter (⅛ inch) along said edge and generally equally spaced on opposite sides of a center line extending between the centers of the attached discs, said discs being separated between said tabs and said tabs being folded to position said abrasive discs in a stack with each abrasive disc in the stack having its layer of abrasive against the layer of abrasive of one adjacent disc, and its loops against the loops of another adjacent disc; and a container enclosing said stack of discs, said container having a bottom wall supporting the bottom disc in said stack, and side walls projecting from said bottom wall along the edges of the discs in said stack.

5. A combination according to claim 4 wherein said two narrow tabs along each edge are spaced by about 1.6 centimeter (⅝ inch) and are each less than about 0.16 centimeter (1/16 inch) wide.

6. A combination according to claim 4 wherein each disc is attached to two adjacent discs at opposite edges by only said two narrow tabs along each edge, said two tabs are spaced by about 1.6 centimeter (⅝ inch) and are each less than about 0.16 centimeter (1/16 inch) wide.

7. A concatenation of circular abrasive discs each including a backing having first and second major surfaces, a layer of abrasive material on said first surface, and means on said second surface for releasably attaching said discs to a drive member, said discs being cut from a single sheet of stock and each disc being attached to two adjacent discs at opposite edges by two narrow tabs along each edge spaced by at least about 0.32 centimeter (⅛ inch) along said edge and generally equally spaced on opposite sides of a center line extending between the centers of the attached discs, said discs being separated between said tabs and said tabs being folded to position said abrasive discs in a stack with each abrasive disc within the stack having its layer of abrasive material against the layer of abrasive material of one adjacent disc, and its means for releasably attaching adjacent the means for releasably attaching of the other adjacent disc.

8. A concatenation of circular abrasive discs according to claim 7 wherein said two narrow tabs along each edge are spaced about 1.6 centimeter ($\frac{5}{8}$ inch) and are each less than about 0.16 centimeter (1/16 inch) wide.

9. A concatenation of circular abrasive discs according to claim 7 wherein each disc is attached to two adjacent discs at opposite edges by only said two narrow tabs along each edge, said two tabs are spaced by about 1.6 centimeter ($\frac{5}{8}$ inch) and are each less than about 0.16 centimeter (1/16 inch) wide.

10. In combination, a concatenation of circular abrasive discs each including a backing having first and second surfaces, a layer of abrasive material on said first surface, and means on said second surface for releasably attaching said discs to a drive member, said discs being cut from a single sheet of stock and each disc being attached to two adjacent discs at opposite edges by two narrow tabs along each edge spaced by at least 0.32 centimeter ($\frac{1}{8}$ inch) along said edge and generally equally spaced on opposite sides of a center line extending between the centers of the attached discs, said discs being separated between said tabs and said tabs being folded to position said abrasive discs in a stack with each abrasive disc in the stack having its layer of abrasive against the layer of abrasive of one adjacent disc, and its means for attaching adjacent the means for attaching of another adjacent disc; and a container enclosing said stack of discs, said container having a bottom wall supporting the bottom disc in said stack, and side walls projecting from said bottom wall along the edges of the discs in said stack.

11. A combination according to claim 10 wherein said two narrow tabs along each edge are spaced about 1.6 centimeter ($\frac{5}{8}$ inch) and are each less than about 0.16 centimeter (1/16 inch) wide.

12. A combination according to claim 10 wherein each disc is attached to two adjacent discs at opposite edges by only said two narrow tabs along each edge, said two tabs are spaced by about 1.6 centimeter ($\frac{5}{8}$ inch) and are each less than about 0.16 centimeter (1/16 inch) wide.

* * * * *